United States Patent [19]

Kanner et al.

[11] Patent Number: 4,917,271

[45] Date of Patent: Apr. 17, 1990

[54] LIQUID DISPENSING NOZZLE ASSEMBLY WITH FILTER

[75] Inventors: Rowland W. Kanner; Joseph V. Ranalletta, both of Guntersville, Ala.; Gregory P. Kracher; Alan D. Parker, both of Baltimore, Md.

[73] Assignees: Ryder International Corporation, Arab, Ala.; pK Scientific, Inc., Frederick, Md. ; a part interest

[21] Appl. No.: 258,208

[22] Filed: Oct. 7, 1988

[51] Int. Cl.[4] ..... B67D 5/58

[52] U.S. Cl. ..... 222/189; 222/213; 222/481; 222/482; 222/568; 239/327

[58] Field of Search ..... 222/189, 212, 213, 481, 222/482, 564, 562, 568; 220/371, 372; 215/261, 308; 239/327, 333; 604/126

[56] References Cited

U.S. PATENT DOCUMENTS

| | | | |
|---|---|---|---|
| 3,149,758 | 9/1964 | Bush et al. | 222/189 |
| 3,176,883 | 4/1965 | Davis | 222/212 X |
| 3,346,146 | 10/1967 | Thompson | 222/189 |
| 4,093,124 | 6/1978 | Morane et al. | 222/189 X |
| 4,113,627 | 12/1978 | Leason | 604/126 X |
| 4,186,882 | 2/1980 | Szczepanski | 239/327 |
| 4,533,068 | 8/1985 | Meierhoefer | 222/189 |
| 4,737,148 | 4/1988 | Blake | 604/126 |
| 4,765,499 | 8/1988 | von Reis et al. | 220/371 X |

*Primary Examiner*—Kevin P. Shaver
*Assistant Examiner*—Boris Milef
*Attorney, Agent, or Firm*—R. A. Giangiorgi

[57] ABSTRACT

A nozzle assembly is provided for a container and dispenser which maintains a supply of liquid, such as saline solution for contact lenses, in sterile condition during storage and has a flexible wall for manually squeezed displacement of the dispensed liquid from a storage cavity within the container. The nozzle assembly includes first and second conduits for defining separate fluid flow paths between an opening from the container and a nozzle from the structure. The first conduit enables flow of the stored liquid to be discharged from the nozzle orifice during squeezing of the flexible wall. The second conduit includes a barrier obstructing flow of the liquid through the second conduit which obstruction is permeable to air and impermeable to bacteria, allowing aspiration of air through the second conduit into the liquid storage cavity to replace the dispensed liquid and re-expand the container wall while preventing entry of any bacteria with the aspirated air.

18 Claims, 4 Drawing Sheets

FIG. 5
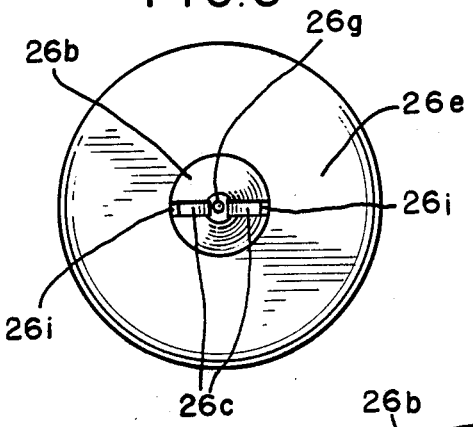
FIG. 6
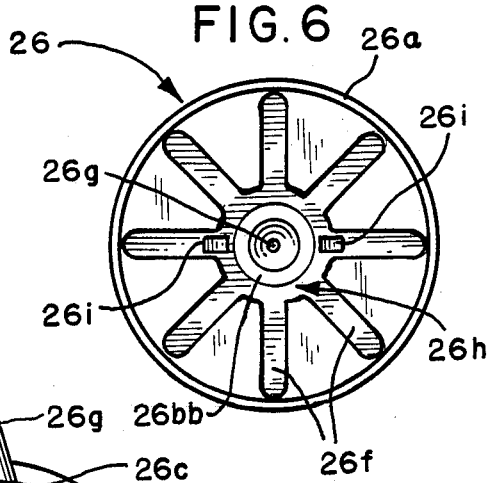
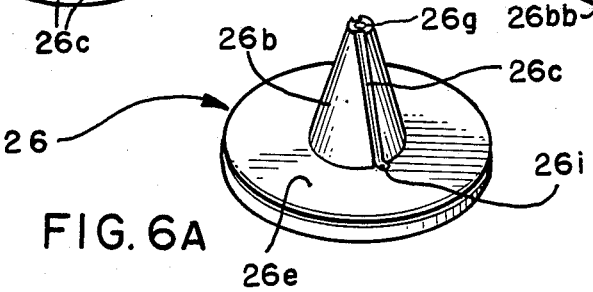
FIG. 6A
FIG. 7
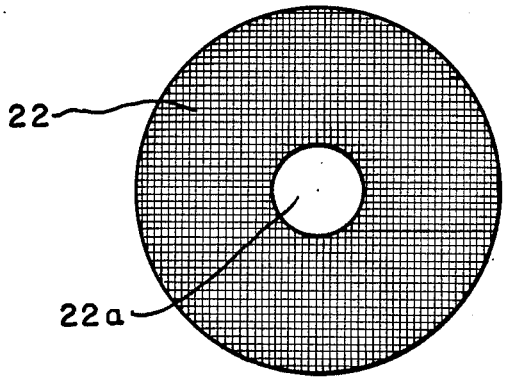
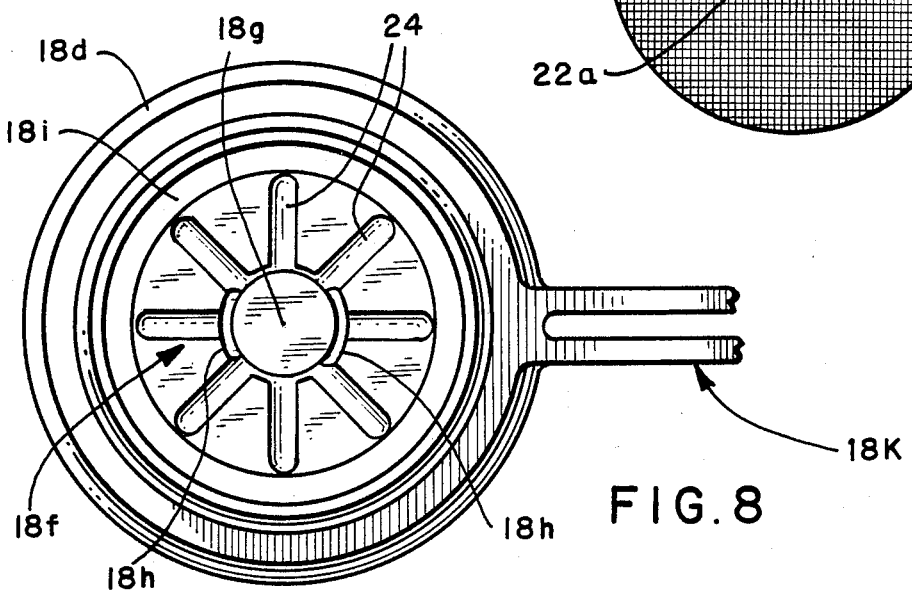
FIG. 8

LIQUID DISPENSING NOZZLE ASSEMBLY WITH FILTER

BACKGROUND OF THE INVENTION

This invention relates to liquid storage containers for manually dispensing liquids such as cleaning solutions for contact lenses, and more particularly relates to dispensing nozzles on containers for liquid which must be stored in generally sterile conditions.

Liquids, for example, solutions for cleaning and conditioning contact lenses, have typically been stored in manually squeezable bottles from which the user can repeatedly dispense the stored liquid. The liquid must be uncontaminated by microorganisms such as bacteria. Accordingly, expensive bacteriacidal agents have often been included in the liquid formulation, for example, saline formulations for cleaning contact lenses. Furthermore, the squeezable dispensing bottles have sometimes been provided with nozzles including filter membranes which are permeable to the dispensed liquid as well as being permeable to the air which must be aspirated through the nozzle to replace the dispensed liquid and reinflate or re-expand the container. The filter membrane must be impermeable to bacteria in order to prevent the aspirated air from carrying bacteria into contact with the stored solution, so that the solution is maintained in sterile condition for repeated dispensing. However, filter membrane materials which are sufficiently hydrophilic to permit permeation of the saline solution often permit retention of the saline solution on the filter so that the retained solution increases the resistance of the filter to passage of the aspirating air. The partially obstructed flow of aspirating air not only retards the re-expansion of the squeezed bottle wall, but also impedes repeated squeezing of the bottle when large quantities of the solution must be dispensed. When portions of the filter are treated to repel the solution and improve air passage, the solution can sometimes leach the treating composition from the filter.

According to the subject invention, a nozzle assembly provides improved air aspiration of the squeezed liquid dispensing container for improved convenience to the user, particularly in repeated dispensing of the solutions for contact lenses.

SUMMARY OF THE INVENTION

According to the subject invention, a nozzle assembly is provided for a container and dispenser which maintains a supply of liquid, such as saline solution for contact lenses, in sterile condition during storage and has a flexible wall for manually squeezed displacement of the dispensed liquid from a storage cavity within the container. The nozzle assembly includes first and second conduits for defining separate fluid flow paths between an opening from the container and a nozzle from the structure. The first conduit enables flow of the stored liquid to be discharged from the nozzle orifice during squeezing of the flexible wall. The second conduit includes a barrier obstructing flow of the liquid through the second conduit which obstruction is permeable to air and impermeable to bacteria, allowing aspiration of air through the second conduit into the liquid storage cavity to replace the dispensed liquid and re-expand the container wall while preventing entry of any bacteria with the aspirated air.

In a preferred embodiment, a unitary filter membrane has both a liquid permeable portion of the filter located within the flow path of the liquid-dispensing conduit and a separate portion of the filter which is rendered impermeable to the liquid such as by treatment with a hydrophobic composition to provide the air-permeable liquid obstruction within the second conduit for the air aspiration. Both portions of the filter membrane are impermeable to bacteria to prevent bacterial contamination of the liquid such as sterile saline solution. When the dispenser is employed to store and dispense typical aqueous saline solution for contact lenses, these two portions of the filter membrane are respectively hydrophilic and hydrophobic.

The nozzle assembly comprises a nozzle member which includes separate portions of the liquid flow conduit and the air aspiration conduit which are in separate, respective communication with the liquid-obstructed portion and with the liquid permeable portion of the filter. In order to promote rapid air aspiration to reinflate the squeezed, flexible container wall to dispense the liquid, the nozzle member preferably includes a central bore which provides the air aspiration conduit portion. This provides a direct air flow path having minimum flow resistance through the nozzle member. The liquid flow conduit portion of the nozzle member is provided by a pair of peripheral grooves which are laterally enclosed and sealed by an internal wall of a nozzle housing which encases the outer surface of the tubular nozzle wall. The grooves are in flow communication with the liquid permeable portion of the unitary filter. The dispensed liquid is discharged through a flow passageway through the nozzle housing which also provides the intake orifice for the air aspiration conduit.

BRIEF DESCRIPTION OF DRAWINGS

The features of the present invention which are believed to be novel are set forth with particularity in the appended claims. The organization and manner of operation of the invention, together with further objects and advantages thereof, may best be understood by references to the following description taken in connection with the accompanying drawings in which like reference numerals identify like elements, and in which:

FIG. 5 is a top plan view of a nozzle structure of the assembly as indicated by the line 5—5 in FIG. 3;

FIG. 6 is a bottom plan view of the nozzle structure as indicated by the line 6—6 in FIG. 3;

FIG. 6A is a perspective view of the nozzle structure shown in FIGS. 5 and 6;

FIG. 7 is a top plan view of a filter membrane of the assembly as indicated by the line 7—7 in FIG. 3; and FIG. 8 is a top plan view of an adapter element of the assembly as indicated by the line 8—8 in FIG. 3.

DETAILED DESCRIPTION OF THE ILLUSTRATED EMBODIMENT

Figure 1:
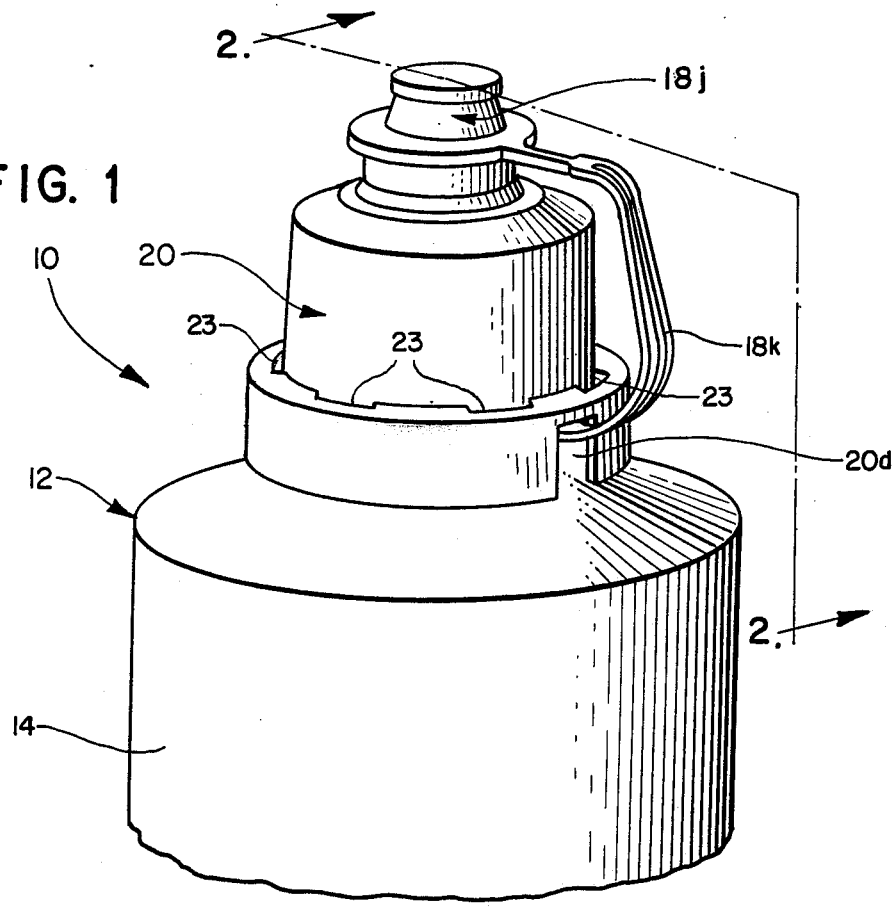
FIG. 1 is a perspective view of an embodiment of a liquid dispensing nozzle assembly of the invention mounted on a liquid storage and dispensing container.
Figure 2:
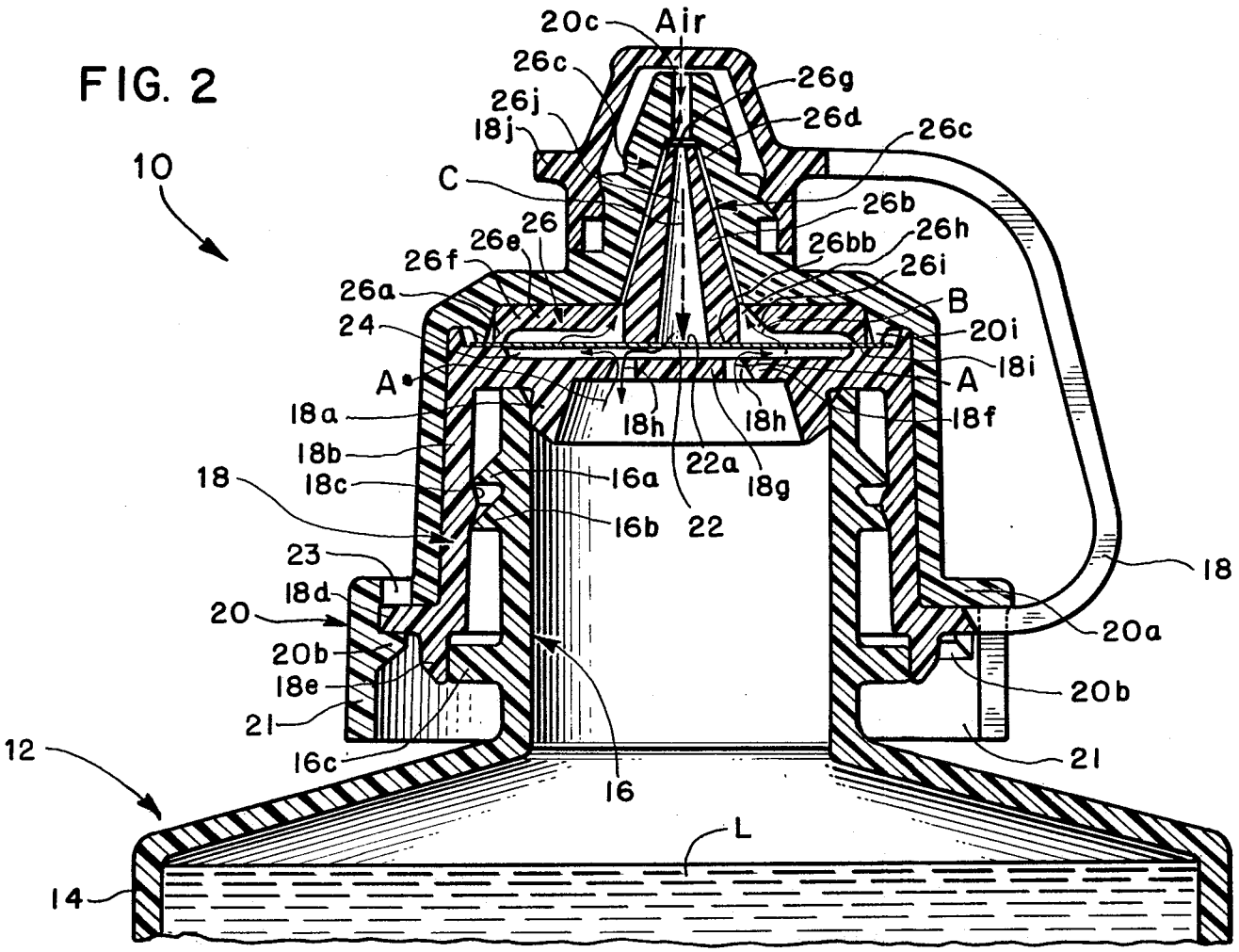
FIG. 2 is a sectional view taken along each of the lines indicated by 2—2 in FIGS. 1 and 4.

Referring to FIGS. 1 and 2, an embodiment of the liquid dispensing nozzle assembly in accordance with this invention is designated generally by a reference character 10. The nozzle assembly 10 is mounted on a molded plastic bottle or container body 12 containing a liquid and having a flexible wall 14 and a neck portion 16 opening at the top as shown in FIG. 2.

A generally cylindrical stopper-adapter 18 surrounds the neck 16. The adapter 18 can be integrally molded from a resin such as polypropylene. The adapter 18 includes an annular, flared internal flange **18*a* which projects downwardly into the opening at the top of the neck 16 and securely engages and seals against the interior surface of the neck. The adapter 18 has an outer cylindrical skirt 18*b* which has an inwardly extending, annular lug 18*c* which is forced between a pair of adjacent, radially outwardly extending annular coupling flanges 16*a*, 16*b* which enable an interference fit with the lug 18*c* to securely mount the adapter 18 in a sealed condition on the bottleneck 16**.

Figure 4:
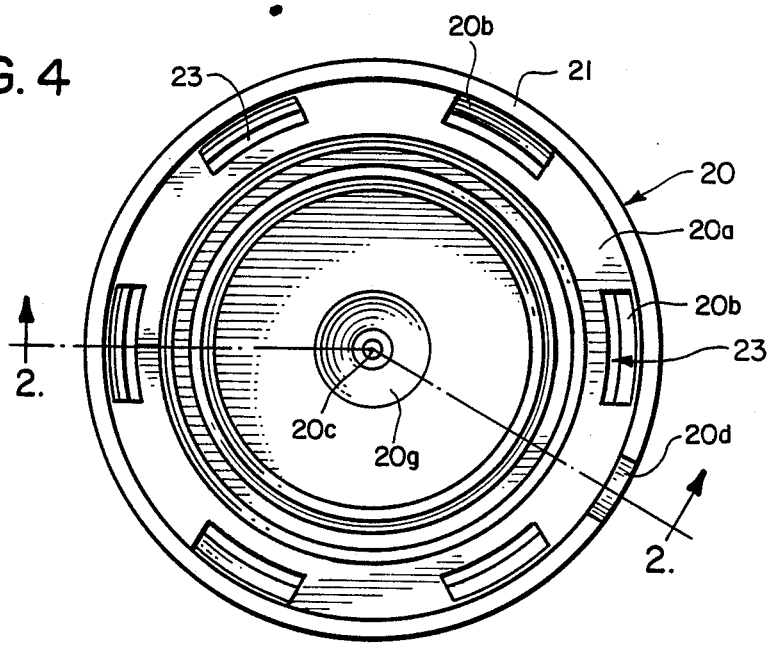
FIG. 4 is a bottom plan view of a nozzle housing of the assembly as indicated by the line 4—4 in FIG. 3.
Figure 3:
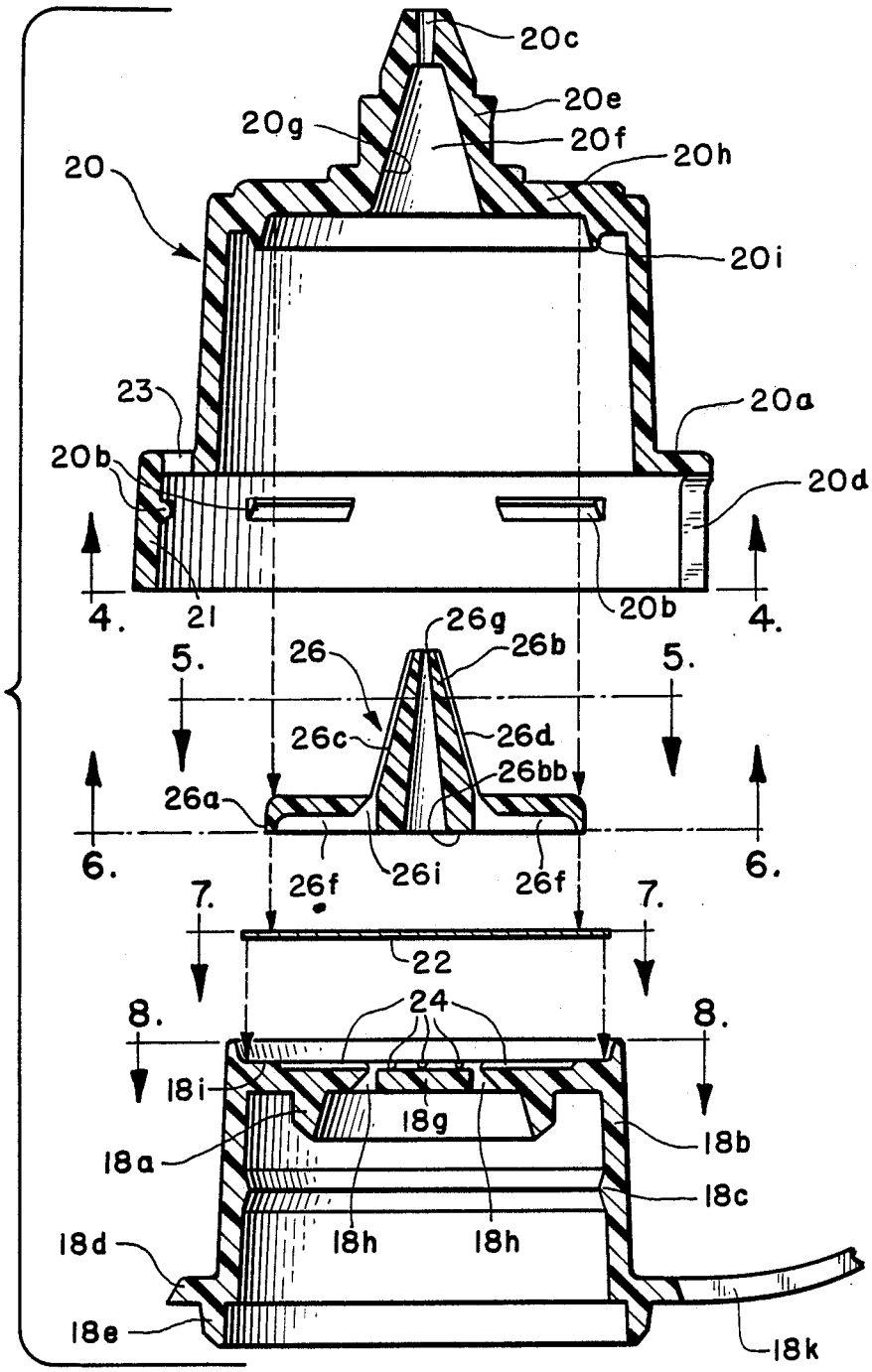
FIG. 3 is an exploded, sectional view of the nozzle assembly in FIGS. 1 and 2.

A radially outwardly extending annular flange **18*d* forms a shoulder at the bottom of the skirt 18*b*, and the shoulder flange 18*d* forms a base on which a generally cylindrical nozzle housing or cap 20 is seated. The flange 18*d* is snap-fit and clamped between an annular shoulder 20*a* of the nozzle housing 20 and an annular arrangement of six spaced, arcuate cleat portions 20*b* projecting inwardly from a lowermost annular skirt portion 21 of the housing 20 as shown in FIGS. 2–4. As shown in FIGS. 2–4, the shoulder wall 20*a* is interrupted by an annular arrangement of six through-slots 23 which are respectively aligned with the six cleats 20*b*; these slots 23** provide tooling access for molding the cleats.

The shoulder flange **18*d* also has a downwardly extending flange portion 18*e* which is abutted against a radially outwardly extending collar flange 16*c* on the bottleneck 16 in order to further stabilize the securement of the adapter 18 on the bottleneck 16**.

As best shown in FIGS. 2, 3 and 8, the adapter 18 further includes a central stopper portion **18*f* which in turn includes a recessed, axially aligned core 18*g*. As best shown in FIGS. 3 and 8, two (2) arcuate apertures or through slots 18*h* are formed through the stopper portion 18*f* on diametrically opposed sides of the circular core 18*g*. The adapter 18 also has an elevated axially facing annular surface 18*i* which surrounds the stopper portion 18*f* and provides a surface on which the peripheral portion of a circular filter membrane 22 is seated as shown in FIGS. 2 and 3** and as more fully described hereinafter.

As shown in FIGS. 2 and 8, the stopper portion **18*f* is subdivided by an annular arrangement of equally spaced and radially extending channels 24 formed in the stopper portion 18*f* which extend between the core 18*g* and the annular seat 18*i* and which communicate with the slots 18*h*. The channels 24 enable fluid flow within the stopper portion as indicated by arrows A (FIG. 2) showing the direction of the liquid flow path. That is, the saline solution flows from the bottleneck 16 through the slots or apertures 18*h* into the channels 24 and then through the filter membrane 22 and into the nozzle structure 26, when the flexible wall 14** is squeezed to dispense the saline solution from the inverted dispenser.

The nozzle structure, shown in FIGS. 3, 5, 6 and 6A and generally designated by reference character 26, has a peripheral annular wall **26*a* which clamps the peripheral portion of the filter membrane 22 against the seat 18*i*. The nozzle structure also includes a central nozzle core 26*b* formed by a frustoconical wall. The nozzle core 26*b* has two upwardly converging, peripheral grooves 26*c* therein providing liquid flow passageways formed between the core 26*b* and an internal wall 20*g* of the nozzle housing 20 which encases the core 26*b*, as well as both the entire nozzle structure 26 and adapter 18 generally as shown in FIG. 2. An annular body wall 26*e* radially extends between the nozzle core 26*b* and the peripheral wall 26*a***.

The body wall **26*e* has an annular pattern of radial channels 26*f* which are respectively aligned with the channels 24 but separated therefrom by the filter membrane 22. Referring to FIG. 6, the radial channels 26*f* lead into an annular channel 26*h* which circumscribes the base of the core 26*b*. As shown in FIGS. 2 and 6, a pair of diametrically opposed slots 26*i* through the nozzle body wall 26*a* enable fluid flow from the annular channel 26*h* into the groove passageways 26*c* as indicated by the arrow B (FIG. 2). Accordingly, the channels 26*f* and 26*h* and the slots 26*i* direct the liquid flowing through the filter membrane 22 into the grooves 26*c* from which the liquid is discharged through a terminal nozzle orifice and aligned outlet orifice 20*c* of the housing 20**.

The nozzle core **26*b* also includes a central bore 26*j* which opens into the orifice 26*g* at its upper end, and at its opposite end is covered by a central portion 22*a* of the filter membrane 22. While the outer annular portion of the filter membrane 22 is hydrophilic to enable the passage of the aqueous saline solution therethrough, the circular central portion 22*a* of the filter membrane is treated to be hydrophobic to prevent permeation or passage of the saline solution through this central membrane portion 22*a***.

The hydrophobic central filter portion **22*a* will tend to be slightly deflectable such that when the flexible wall 14 is squeezed to dispense the saline solution, the hydraulic pressure of the solution forces the annular periphery of the hydrophobic filter portion 22*a* to seal against the annular end face 26*bb* of the nozzle core 26*b* (as shown in FIG. 2) to create a seal therebetween which prevents any leakage of saline solution from the radial channels 26*f* under the face 26*bb* into the central bore 26*j*. Such leakage could otherwise cause accumulation of the saline solution within the bore 26*j* and partial obstruction of air passage therethrough as more fully described hereinafter. Moreover, such leakage could also cause leaching of the hyhdrophobic treating composition from the upper surface of the central filter portion 22*a*. Thus, filter central portion 22*a* creates an obstruction to any passage of saline solution through the bore 26*j* during dispensing of the solution. The hydrophobic filter membrane obstruction 22*a* assures that the liquid flow of saline solution follows the flow path indicated by the arrows A and B so that all of the liquid flow passes through the groove passageways 26*c*. Suitable hydrophilic filter membranes can be fabricated, for example, from supported acrylic copolymer which can be treated with a siloxane composition to provide the filter membrane with a hydrophobic, but air permeable, central portion 22*a*. Such combination hydrophilic and hydrophobic portions in a single filter membrane are commercially available, for example, from Gelman Sciences in a particularly suitable composition designated Versapor-450 having a pore size of approximately 0.45 micron which is impenetrable to bacteria in order to preserve the stored saline solution in sterile condition within the dispenser 10**.

From the groove passageways **26*c*, the liquid flow is directed into the outlet orifice 20*c*, which forms a somewhat elongated passageway in the end of the nozzle housing 20 wherefrom the saline solution is discharged and dispensed when a snap-fitting cover 18***j* is removed from the nozzle housing 20. The cover 18*j* has a cup-like configuration and is connected by an integrally molded flexible connecting web 18*k* which passes through a notch 20*d* formed in the skirt 21 of the nozzle housing 20 and is joined to a portion of the annular adapter shoulder 18*d* as best shown in FIG. 1.

Referring to FIGS. 2 and 3, the nozzle housing 20 includes a casing portion 20*e* from which the elongate passageway 20*c* opens. The casing 20*e* has an internal cavity 20*f* defined by a surrounding frustoconical wall 20*g* which conforms to and seals against the frustoconical outer wall 26*d* of the nozzle structure in order to prevent any leaking of the dispensed saline solution therebetween when the solution is dispensed through the nozzle grooves 26*c* and orifice 26*g*. The nozzle housing also includes an upper wall 20*h* which tightly clamps the annular body wall 26*e* of the nozzle structure against the membrane 22, and the wall 20*h* includes an axially extending annular flange 20*i* which surround the adjacent flange 26*a* and further clamps the periphery of the filter membrane 22 against the seat surface 18*i*.

Since the central filter membrane portion 22*a* is hydrophobic, it is also resistant to adherence of or saturation by the dispensed saline solution which then follows the flow path through the annular portion 22 of the filter membrane as indicated by the arrows A and B. Accordingly, the central filter membrane portion 22*a* remains unsaturated by saline solution and therefore further facilitates inflowing aspiration of air from the port 20*a* and the bore 26*j* as indicated by the arrow C.

Following the dispensing of the saline solution, the pressure of the aspirating air will tend to force any residual saline solution adhering to the groove passageways 26*c* backwardly against the annular filter membrane portion 22 which will in any case generally remain saturated with the solution and thus obstructs passage of the aspirating air therethrough in the direction opposite to the arrows A and B indicating the flow path of the dispensed liquid saline solution; accordingly, the aspirating air flows through the direct and central flow path through the bore 26*j* and central membrane portion 22*a* (Arrow C), and this central flow path permits particularly rapid reinflation of the container 12 and flexible wall 14. Hence, there is no significant delay in enabling the user to repeatedly squeeze the dispenser and to discharge a saline solution when large quantities of the solution are required.

As a result of the hydrophobic obstruction formed by the central filter membrane portion 22*a*, when the saline solution is dispensed the solution flows only in the flow path through the annular hydrophilic portion of the filter membrane 22 from the entry through slots 18*h*. Then the solution flows into the groove passageways 26*c* which discharge the solution through the outlet orifice 20*c* as indicated by the arrows A and B.

After dispensing the saline solution, the aspirating air flows inwardly through the hydrophobic central filter membrane portion 22*a* from the nozzle bore 26*j* along the flow path indicated by arrow C. The aspirating air pressure can tend to cause the hydrophobic central filter portion 22*a* to slightly unseat from the core face 26*bb*, however, the entire filter membrane is impermeable to bacteria and therefore maintains the stored saline solution in sterile condition within the dispenser 10 while enabling repeated dispensing of the solution and air aspiration.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A liquid dispensing nozzle assembly for mounting on a liquid container and dispenser having a flexible wall and liquid storage cavity for manually squeezed dispensing of liquid from the cavity through the nozzle assembly and for maintaining the liquid, such as contact lens saline sterile condition during storage and repeated dispensing of the liquid from the container cavity, said nozzle assembly comprising:

at least first and second conduit means for providing separate fluid flow paths, said first and second conduit means including common passageway means formed in said nozzle assembly, said first conduit means enabling flow of said liquid therethrough in order to discharge said liquid from said nozzle assembly during said manual liquid dispensing; and a barrier means formed within said second conduit means providing an obstruction to flow of said liquid therethrough, said obstruction being permeable to air and impermeable to bacteria thereby enabling only aspiration of air through said second conduit into said cavity to replace liquid dispensed therefrom, and said common passageway means comprising a terminal orifice in said nozzle assembly which forms both a liquid discharge orifice from said first conduit means and an air aspiration intake orifice in said second conduit means.

2. The nozzle assembly as claimed in claim 1, wherein said barrier means is defined by a portion of a filter having said impermeability to bacteria.

3. The nozzle assembly according to claim 2, wherein said filter further includes a liquid permeable portion thereof located within said first, liquid-dispensing conduit means.

4. The nozzle assembly according to claim 3, wherein said liquid permeable portion of said filter is defined by an annulus circumscribing a central portion of said filter defining said barrier means and liquid obstruction.

5. The nozzle assembly according to claim 3, wherein said liquid obstruction portion of said filter comprises a hydrophobic composition.

6. The nozzle assembly according to claim 5, wherein both of said liquid permeable and liquid impermeable portions of said filter are permeable to air to allow aspiration of air through both of said first and second conduit means.

7. The nozzle assembly according to claim 1, wherein said nozzle assembly includes a tubular wall having a central through-bore forming a portion of said liquid obstructed, second conduit means.

8. The nozzle assembly according to claim 7, wherein said tubular wall further comprises at least a portion of said first liquid flow conduit means.

9. The nozzle assembly according to claim 1, further comprising an adapter portion for securement to a neck portion of said container.

10. The nozzle assembly according to claim 9, wherein said nozzle assembly further includes a nozzle member including separate portions of said first and second conduit means.

11. The nozzle assembly according to claim 10, wherein said barrier means comprises a filter member secured between said nozzle member and said adapter member.

12. The nozzle assembly according to claim 11, wherein said adapter member includes said common passageway means communicating said filter member with said neck portion for fluid flow therebetween.

13. The nozzle assembly according to claim 12, wherein said common passageway means includes a plurality of radially extending channels in communication with said filter member.

14. A liquid dispensing nozzle assembly for mounting on a liquid container and dispenser having a flexible wall and liquid storage cavity for manually squeezed dispensing of liquid from the cavity through the nozzle assembly and for maintaining the liquid, such as contact lens saline solution, in sterile condition during storage and repeated dispensing of the liquid from the container cavity, said nozzle assembly comprising:

at least first and second conduit means for providing separate fluid flow paths, said first and second conduit means including common passageway means formed in said nozzle assembly, said first conduit means enabling flow of said liquid therethrough in order to discharge said liquid from said nozzle assembly during said manual liquid dispensing; and a barrier means formed within said second conduit means providing an obstruction to flow of said liquid therethrough, said obstruction being permeable to air and impermeable to bacteria thereby enabling only aspiration of air through said second conduit into said cavity to replace liquid dispensed therefrom; and a tubular wall having a central through-bore forming a portion of said liquid obstructed, second conduit means, wherein said tubular wall includes at least one peripheral groove therein defining a portion of said first liquid flow conduit means.

15. The nozzle assembly according to claim 14, wherein said groove is laterally enclosed and sealed by an internal wall of a nozzle housing which encases the outer surface of said tubular wall.

16. The nozzle assembly according to claim 15, wherein said tubular wall has a conical configuration and wherein said groove axially extends to an end of said tubular wall adjacent an opening from said central bore.

17. A liquid dispensing nozzle assembly for mounting on a liquid container and dispenser having a flexible wall and liquid storage cavity for manually squeezed dispensing of liquid from the cavity through the nozzle assembly and for maintaining the liquid, such as contact lens saline solution, in sterile condition during storage and repeated dispensing of the liquid from the container cavity, said nozzle assembly comprising:

at least first and second conduit means for providing separate fluid flow paths, said first and second conduit means including common passageway means formed in said nozzle assembly, said first conduit means enabling flow of said liquid therethrough in order to discharge said liquid from said nozzle assembly during said manual liquid dispensing; and a barrier means formed within said second conduit means providing an obstruction to flow of said liquid therethrough, said obstruction being permeable to air and impermeable to bacteria thereby enabling only aspiration of air through said second conduit into said cavity to replace liquid dispensed therefrom; a nozzle member including separate portions of said first and second conduit means; an adapter portion for securement to a neck portion of said container and a nozzle housing which encases said nozzle member and secures said nozzle member to said adapter member.

18. A container and dispenser for maintaining a supply of liquid, such as saline solution for contact lenses, in sterile condition during storage and repeated dispensing of the liquid from the container, comprising:

a molded container body having a liquid storage cavity therein and having an opening from said cavity through said container body, said container body further having a flexible wall for manually squeezed dispensing of said liquid from said storage cavity; a nozzle assembly connected to said container body and having at least first and second conduits for separate fluid flow paths, said first and second conduits including a common passageway formed in said nozzle assembly, said first conduit enabling flow of said liquid therethrough in order to discharge said liquid from said nozzle assembly during said manual liquid dispensing; and a barrier means formed within said second conduit providing an obstruction to flow of said liquid therethrough, said obstruction being permeable to air and impermeable to bacteria thereby enabling only aspiration of air through said second conduit into said cavity to replace liquid dispensed from said cavity, and said common passageway means comprising a terminal orifice in said nozzle assembly which forms both a liquid discharge orifice from said first conduit means and an air aspiration intake orifice in said second conduit means.

* * * * *